US009248495B2

(12) United States Patent
Doster et al.

(10) Patent No.: US 9,248,495 B2
(45) Date of Patent: Feb. 2, 2016

(54) PLATFORM FOR DIE CASTING MACHINE

(71) Applicant: Toyota Motor Engineering & Manufacturing North America, Inc., Erlanger, KY (US)

(72) Inventors: David R. Doster, McKenzie, TN (US); Jeffery L. Butler, Henderson, TN (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/863,682

(22) Filed: Apr. 16, 2013

(65) Prior Publication Data

US 2014/0305739 A1 Oct. 16, 2014

(51) Int. Cl.

| | |
|---|---|
| ***E04G 3/24*** | (2006.01) |
| ***B22D 17/00*** | (2006.01) |
| ***E04G 1/15*** | (2006.01) |

(52) U.S. Cl.

CPC ..... *B22D 17/00* (2013.01); *E04G 1/152* (2013.01); *E04G 3/24* (2013.01)

(58) Field of Classification Search

CPC ..... E04G 1/152; E04G 1/28; E04G 3/24
See application file for complete search history.

(56) References Cited

U.S. PATENT DOCUMENTS

| | | | | |
|---|---|---|---|---|
| 2,632,591 | A * | 3/1953 | Loomis | 182/115 |
| 2,869,769 | A * | 1/1959 | Robinson | A45C 9/00 206/216 |
| 2,962,293 | A * | 11/1960 | Malami | 280/639 |
| 3,613,139 | A * | 10/1971 | Hansgen | 14/2.6 |
| 4,180,878 | A * | 1/1980 | Howell | A47C 27/085 482/142 |
| 5,356,279 | A | 10/1994 | Fuller et al. | |
| 2007/0273112 | A1 | 11/2007 | Brink | |
| 2010/0269446 | A1 * | 10/2010 | Merrifield | 52/646 |
| 2012/0211193 | A1 | 8/2012 | Bochiechio et al. | |

* cited by examiner

*Primary Examiner* — Alvin Chin-Shue

(74) *Attorney, Agent, or Firm* — Christopher G. Darrow; Darrow Mustafa PC

(57) ABSTRACT

A platform mountable in a lower part of a die casting machine below the platens. The platform includes at least one pair of first and second coupled plates, the first plate affixed to an underlying base of the platform. The second plate is movable between first retracted positions overlaying the first plate to a second extended end-to-end co-planar position relative to the first plate to form an elongated co-planar platform surface. The base can support two pairs of coupled and longitudinally spaced first and second plates. An actuator coupled to each second plate for moving each second plate between the first retracted position and the second extended position.

17 Claims, 15 Drawing Sheets

PLATFORM FOR DIE CASTING MACHINE

BACKGROUND

The present disclosure relates, in general, to platforms and die casting machines and, more particularly, platforms mountable in die casting machines.

Die casting is a common manufacturing process in which molten metal is injected at a high pressure into a metal mold. The die casting machine includes a die assembly formed of one die mounted on a stationary or fixed platen in the machine frame and second die mounted on a movable platform which slides along tie rods in the top and bottom part of the machine frame.

Typically, after the dies have been opened and the formed metal part removed, the dies are sprayed to lubricate and clean the dies for a subsequent casting operation. The spraying operation introduces fluid or oils in between the open dies and platens, which falls to a pit in the bottom portion of the machine frame. Metal flash from a die casting operation also falls into the pit.

Frequently one or more operators enter the die casting machine when the dies are in the open position for maintenance, die cleaning, spraying, etc. One or more platforms have been mounted in the lower portion of the machine frame below the movable dies. An example of a prior art platform is shown in FIGS. 1A, 1B and 1C. A support plate is mounted on a scissors linkage to be elevatable to a selected height to accommodate different height workers. Typically, two such plates are mounted in a spaced apart manner across the lateral width of the die casting machine, generally over covers mounted on the die casting machine linear guides. One manually inserted bridge element spans the space between the two plates as shown in FIG. 1B. Due to the need for worker's safety, the bridge element is necessarily made of a strong metal construction and typically weighs about 30 pounds. In this manner, the bridge element and the two elevatable plates form an elongated platform across the width of the die casting machine to support a worker during machine maintenance.

However, such platforms have inherent safety hazards, in addition to the need for the worker to carry a 30-pound bridge element and attach it to spaced elements to the pair of elevatable trays.

The aforementioned fluid overspray, oil, grease and metal flash accumulates in the bottom portion or pit of the die casting machine and can accumulate on top of the linear guides covers and the platform plates. These accumulated fluids and metal flash pose a safety hazard to workers entering the die casting machine.

Further, there is a large lateral gap and a height differential between the operator platforms on opposite sides of the die casting machine and the elevated position of the plates and bridge elements inside of the die casting machine. This gap, which may exceed 13 inches in length in addition to a 13-16 inch drop in height elevation from the nearby operator's platform, also poses a significant hazard to machine workers.

While addressing the safety hazards posed by prior art platforms mounted inside of die casting machines, the large size of the machine, in particular the movable die platen, needs to be taken into account since any platform mountable within the die casting machine must be stored below the bottom edge of the movable platen to provide platen clearance during die casting operations.

SUMMARY

An apparatus for use in a machine having first and second members movable relative to each other across an open area includes a platform adapted to be mounted in the open area of the machine. The platform includes a first pair of first and second plates, the first plate adapted to be stationarily positioned relative to the machine. The second plate is movable relative to the first plate of each pair of first and second plates between a first position folded over the respective first plate and a second extended end-to-end co-planar position with the first plate.

The second plate is pivotally coupled to the first plate of the pair of first and second plates.

The apparatus can have a first base adapted to be disposed in a lower portion of the die casting machine. The first base supports the first pair of first and second plates.

The first plate of the first pair of plates can be fixed to the first base.

The apparatus including an actuator coupled to the second plate for moving the second plate between the first retracted position and the second extended position.

In another aspect, the apparatus can include a second pair of first and second plates, the first plate of the second pair of plates adapted to be stationarily positioned relative to the die casting machine. The second plate of the second pair of plates is movable relative to the first plate of the second pair of plates between a first retracted position overlaying the first plate of the second pair of plates to a second extended end-to-end position co-planar with the first plate of the second pair of plates.

The apparatus can include a second base adapted to be mountable in a lower portion of the machine. The second base supports the second pair of plates.

The second plate of the first pair of plates can be movable to the second extended position in-between the first plates of the first and second pair of plates to form a continuous end to end co-planar surface between the first plates of the first and second pair of plates and the first movable plate of the first pair of plates.

The apparatus can include a first support carried on one of second base and the first plate of the second pair of plates for supporting an end portion of the second plate of the first pair of plates when the second plate of each pair of the first second plates is in the second extended position.

The apparatus can include a second support member carried on the second plate of the second pair of plates for supporting an end portion of the second plate of the second pair of plates when the second plate is in the second extended position.

The second plate of the first and second pairs of plates can be pivotally coupled to the respective first plate of the first and second pairs of plates for pivotal movement in the same direction between the first retracted position and the second extended position.

The second plate of the first and second pairs of plates can be pivotally coupled to the respective first plate of the first and second pairs of plates for pivotal movement in the opposite direction between the first retracted position and the second extended position.

In another aspect, the first and second lower supports are respectively coupled to the first and second bases and extend oppositely from each other. The first stationary plate of each of the first and second pairs of plates is fixedly coupled to one of the first and second lower supports.

Each of the first and second lower support can fixedly carry a tread plate which remains exposed when the second movable plates of the first and second pairs of plates are in the first retracted position.

Each of the first and second plates of each of the first and second pairs of plates have a tread plate surface which is exposed when the second movable plates of each of the first and second pairs of plates are in the second extended position. In one aspect, second movable plates of each of the first and second pairs of plates carry another tread plate facing oppositely and outward from the tread plate which is exposed when the second movable plates are in the first retracted position.

In another aspect, an apparatus for use in a machine having first and second members movable relative to each other across an open area includes a platform adapted to be mounted in the open area of the machine. The platform includes a base adapted to be disposed in a lower portion of the machine. The platform includes a first pair of first and second plates, the first plate of each pair of first and second plates is fixed to the base. The first plate of the second pair of plates is also fixed to the base. The second plate of each of the first and second pairs of plates is movable relative to the respective first plate between a first position folded over the respective first plate of the first and second pairs of plates and a second extended end-to-end co-planar position with respect to both of the first plates.

The second plate can be pivotally coupled to the first plate of each of the first and second pairs of plates.

A first actuator coupled to the second plate of the first pair of plates for moving the second plate of the first pair of plates between the first retracted position and the second extended position. A separate actuator can be coupled to the first plate of the second pair of plates for moving the second plate of the second pair of plates between the first retracted position and the second extended position.

A first support can be carried on the base and the first plate of the second pair of plates for supporting an end portion of the second plate of the first pair of plates when the second plate is in the second extended position.

A second support can be carried on the second plate of the second pair of plates for supporting an end portion of the second plate of the second pair of plates when the second plate is in the second extended position.

The second plate of the first and second pairs of plates can be pivotally coupled to the respective first plate of the first and second pairs of plates for pivotal movement in the same direction between the first retracted position and the second extended position.

The second plate of the first and second pairs of plates can be pivotally coupled to the respective first plate of the first and second pairs of plates for pivotal movement in the opposite directions between the first retracted position and the second extended position.

In another aspect, the first and second lower supports are respectively coupled to the first and second bases and extend oppositely from each other. The first stationary plate of each of the first and second pairs of plates co-fixedly coupled to one of the first and second lower supports.

Each of the first and second lower supports can fixedly carry a tread plate which remains exposed when the second movable plates of the first and second pairs of plates are in the first retracted position.

Each of the first and second plates of each of the first and second pairs of plates have a tread plate surface which is exposed when the second movable plates of each of the first and second pairs of plates are in the second extended position. In one aspect, the second movable plates of each of the first and second pairs of plates carrying another tread plate facing oppositely from the tread plate which is exposed when the second movable plates are in the first retracted position.

A platform apparatus includes a base adapted to be disposed in a lower portion of the die casting machine. A first pair of first and second plates has a first plate fixed to the base and the first plate of the second pair of plates fixed to the base. The second plate of each of the first and second pairs of plates is movable relative to the respective first plate between a first position folded over the respective first plate of the first and second pairs of plates and a second extended end-to-end co-planar position with both of the first plates.

The second plate can be pivotally coupled to the first plate of each of the first and second pairs of plates.

An actuator can be coupled to the second plate of the first pair of plates for moving the second plate of the first pair of plates between the first retracted position and the second extended position. A separate actuator can be coupled to the second plate of the second pair of plates for moving the second plate of the second pair of plates between the first retracted position and the second extended position.

A first support member can be carried on the base and the first plate of the second pair of plates for supporting an end portion of the second plate of the first pair of plates when the second plate is in the second extended position.

A second support can be carried on the second plate of the second pair of plates for supporting an end portion of the second plate of the second pair of plates when the second plate is in the second extended position.

BRIEF DESCRIPTION OF THE DRAWING

The various features, advantages, and other uses of the present platform for a die casting machine will become more apparent by referring to the following detailed description and drawing in which.

DETAILED DESCRIPTION

Figure 1A:
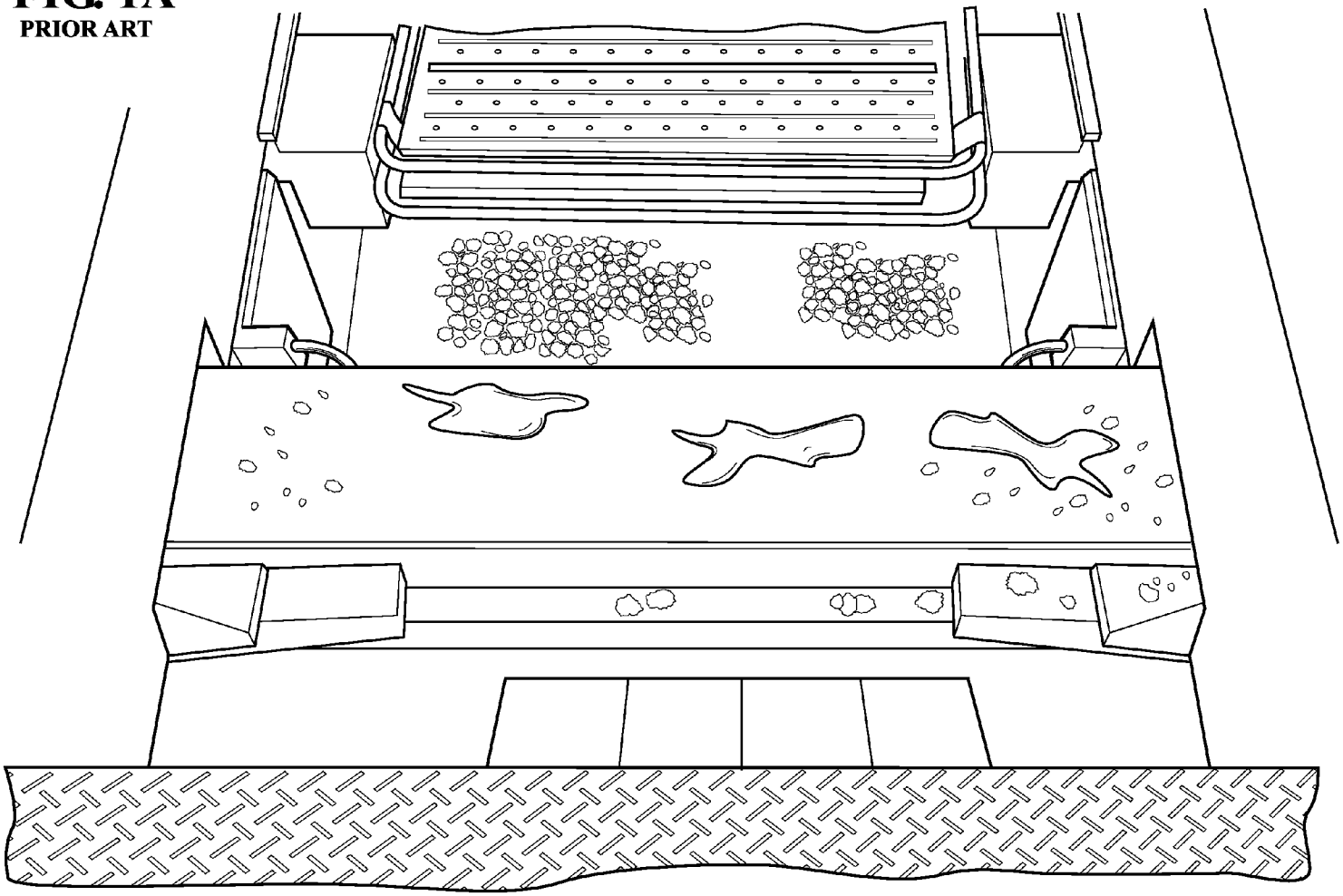
FIG. 1A PRIOR ART
FIGS. 1A, 1B, and 1C are perspective views of a prior art die casting machine platform.
Figure 1B:
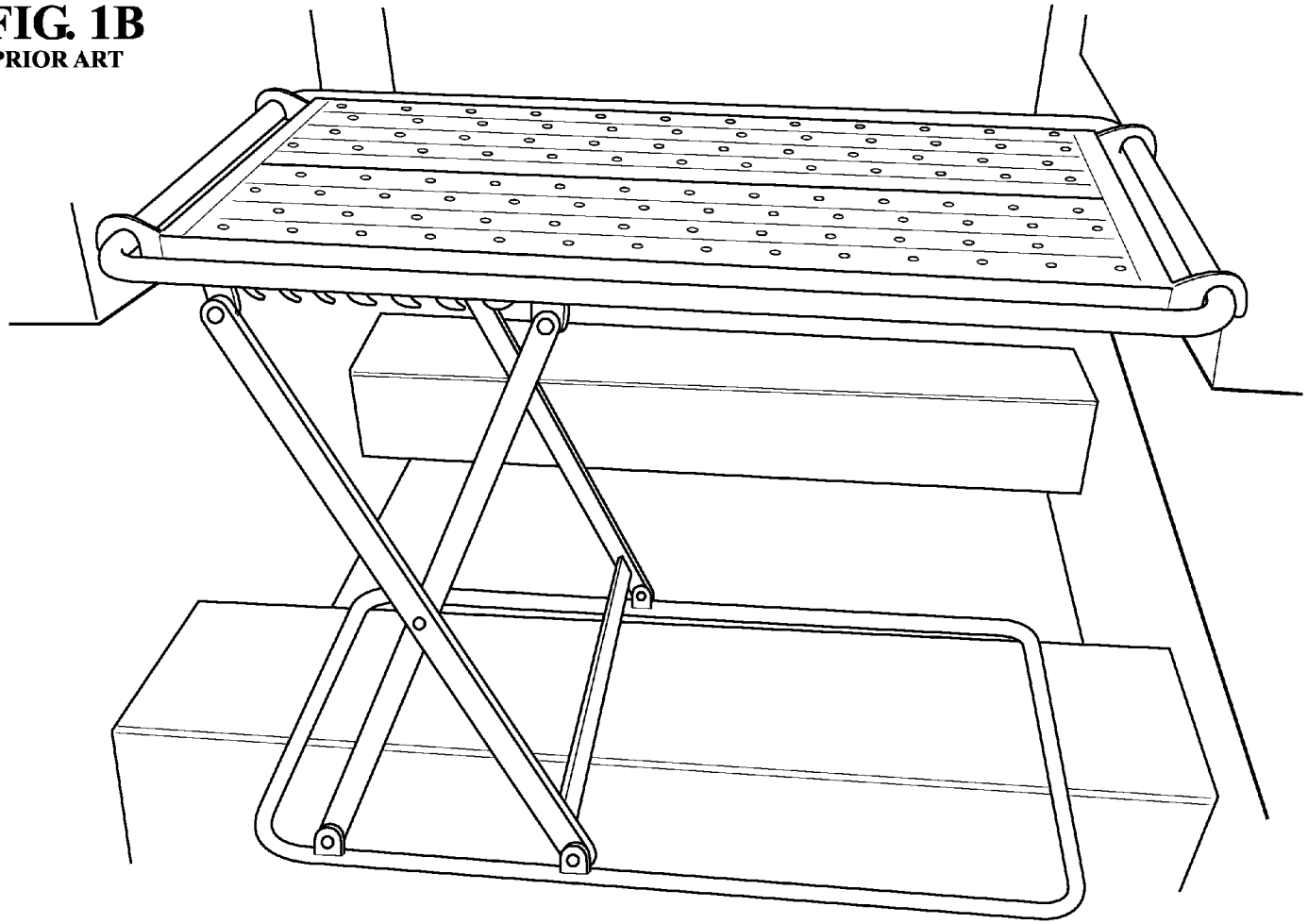
FIG. 1B PRIOR ART
Figure 1C:
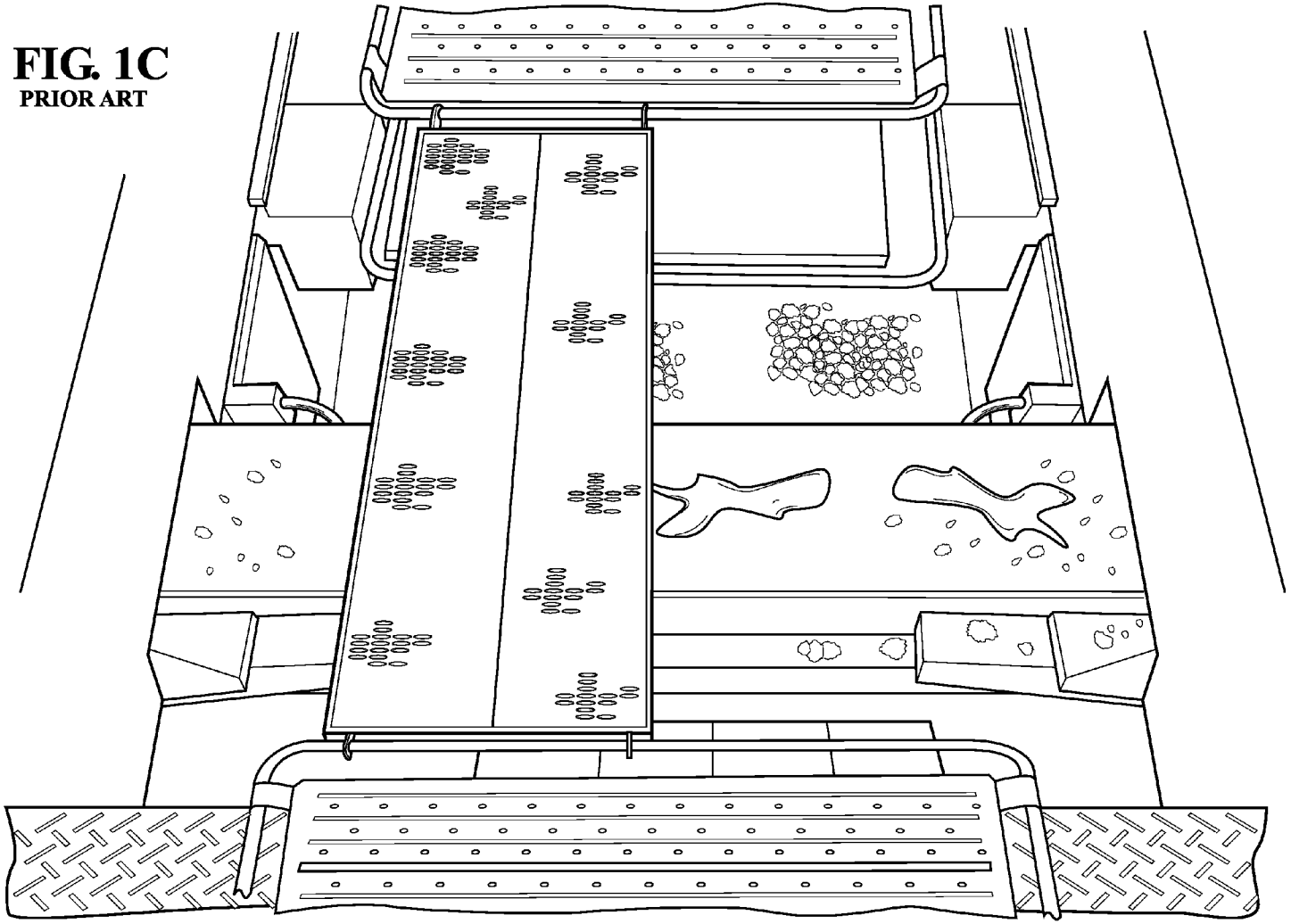
FIG. 1C PRIOR ART

Referring now to the drawings and, in particular, to FIGS. 1-13, there is depicted a platform 20 configured for mounting in a laterally extending pit or bottom portion of a machine, such as, for example a die casting machine. The platform 20 is configured for mounting over and in fixed attachment to tie rod covers 24 over the tie rods of the die casting machine 22.

The platform 20, as described hereafter, is configured for articulation or movement between a folded up, retracted, storage position and a fully extended position. In both positions, the platform 20 is spaced below the bottom surface of the movable members, such as the platens and dies of the die casting machine 22.

The platform 20 can be formed of a strong, structural material, such as steel. Individual steel members, shown by example as formed of angle iron with two 90° oriented legs, are used to form the base 30 of the platform 20. It will be understood that other structural steel members, such as solid bars, rectangular or circular tubes, etc. may also be used by themselves or in combination with angle irons to construct the base 30. The base 30 is configured to be mounted in a laterally extending direction across the width of a die casting machine in the pit or bottom portion of the die casting machine.

For example, the base 30 has an elevated first end portion 32 extending from one operator's platform 33 on the die casting machine 22 to an opposed elevated second end portion 34 which is disposed adjacent to another operator's platform 35 on the die casting machine 22.

Leg assemblies 36 and 38, respectively support the elevated first and second end portions 32 and 34. Each leg assembly 36 and 38 includes a pair of vertically extending legs 40 and 42 and an upper brace 44 extending between the upper ends of the legs 40 and 42. Angular side braces 46 and 48 are joined, such as by welding, mechanical fasteners, etc., to the legs 40 and 42 at one end and the elevated first and second end portions 32 or 34.

Each first and second end portion 32 and 34 is formed of a generally U-shaped assembly of three angle members including a pair of side legs 50 and 52 and a cross-wise extending end leg 54.

The base 30 has a recessed center portion 60 formed of a pair of spaced end assemblies 62 and 64. The end assemblies 62 and 64 each include a pair of laterally spaced, vertically extending legs 66 and 68, a lower crosswise support 70 and an upper crosswise support 71.

Welding or mechanical fasteners on one end of the side legs 52, respectively join the upper ends of the side legs 66 and 68, to the elevated portions 32 and 34 of the base 30. Longitudinally extending leg members 76 and 78 extend between and are joined to the spaced legs 66 and 68.

Figure 3:
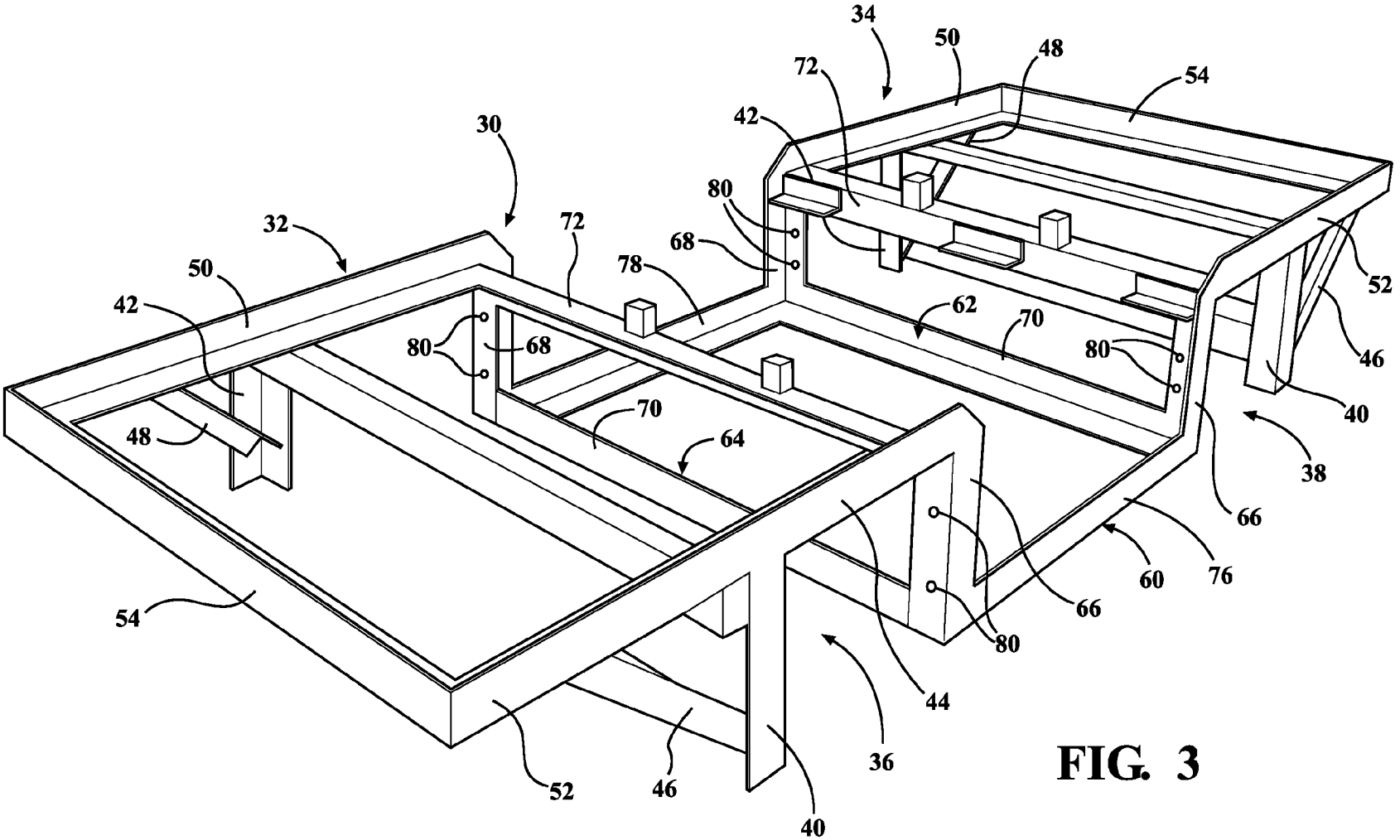
FIG. 3 is a perspective view of the base of the platform shown in FIG. 2.

As seen in FIG. 3, the legs 40 and 66 as well as the legs 42 and 68 are spaced apart and joined at their upper ends by portions of the side legs 50 and 52 of each first and second end portion 32 and 34 of the base 30. The joined legs form a pair of tunnels through which the tie rod covers 24 of the die casting machine are disposed. Bolt holes 80 are mounted in the leg 66 and 68 of each end assembly 62 and 64 for mechanically fixing the base 30 to the tie rod covers 24 of the die casting machine 22.

It will be understood that the above described configuration of the base 30 with the first and second end portions 32 and 34 is by way of example only. It is also possible to configure the base 30 with a single first or second end portion 32 or 34, and only a single pair of plate assemblies, as described hereafter. Alternately, the base 30 may be formed of two separate bases, respectively having the first and second end portions 32 or 34, without a recessed center portion 60 as shown in FIG. 3 and generally constituting one half of the base 30. The two separate bases 30 can each carry an individual plate assembly, as described hereafter. In the former example of a single base carrying a single plate assembly, the base and the plates of the plate assemblies can be elongated so that a single pair of plates of one plate assembly spans a substantial portion of the open width of the die casting machine.

Figure 2:
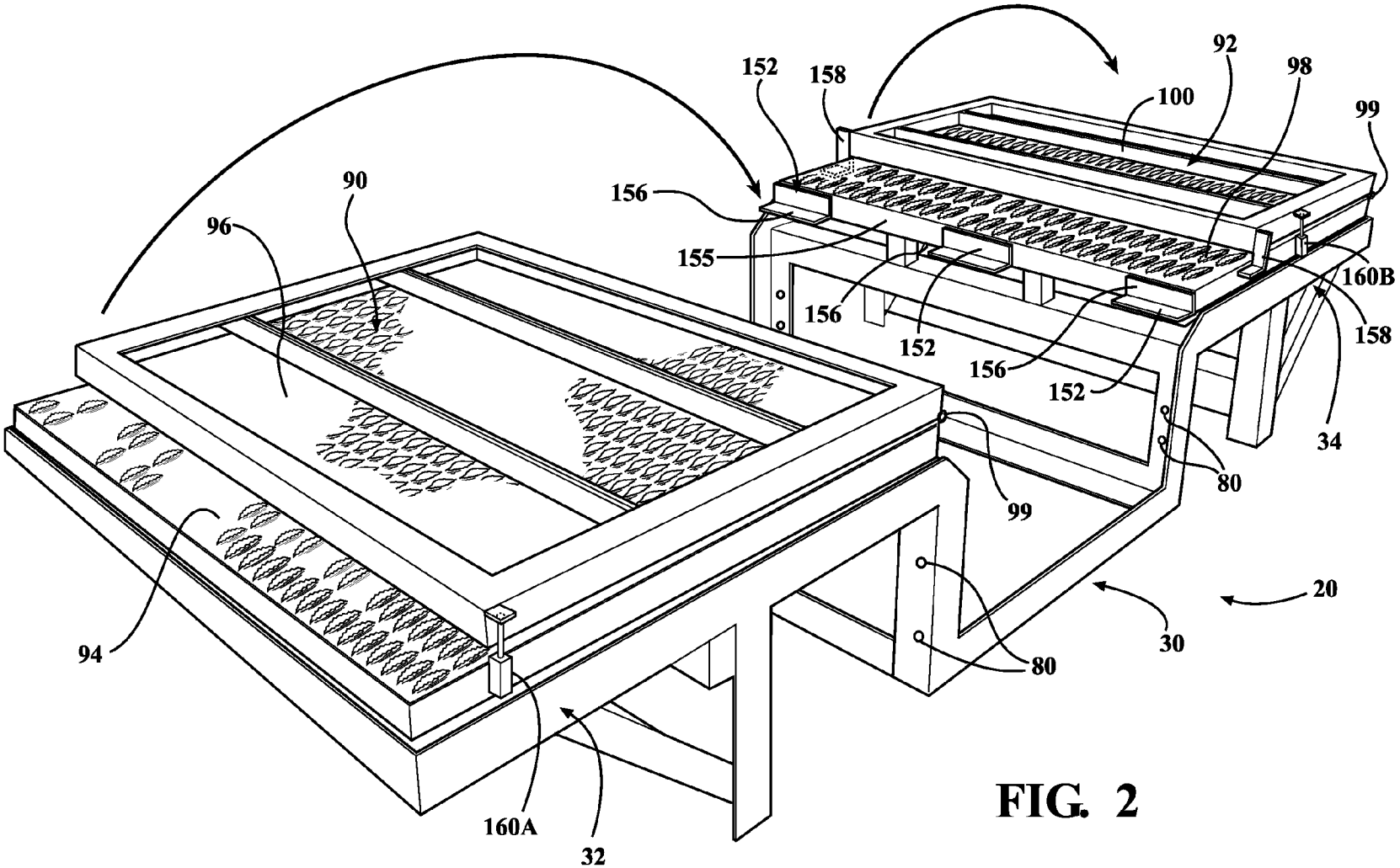
FIG. 2 is a perspective view of a platform which can be employed in a die casting machine.
Figure 4:
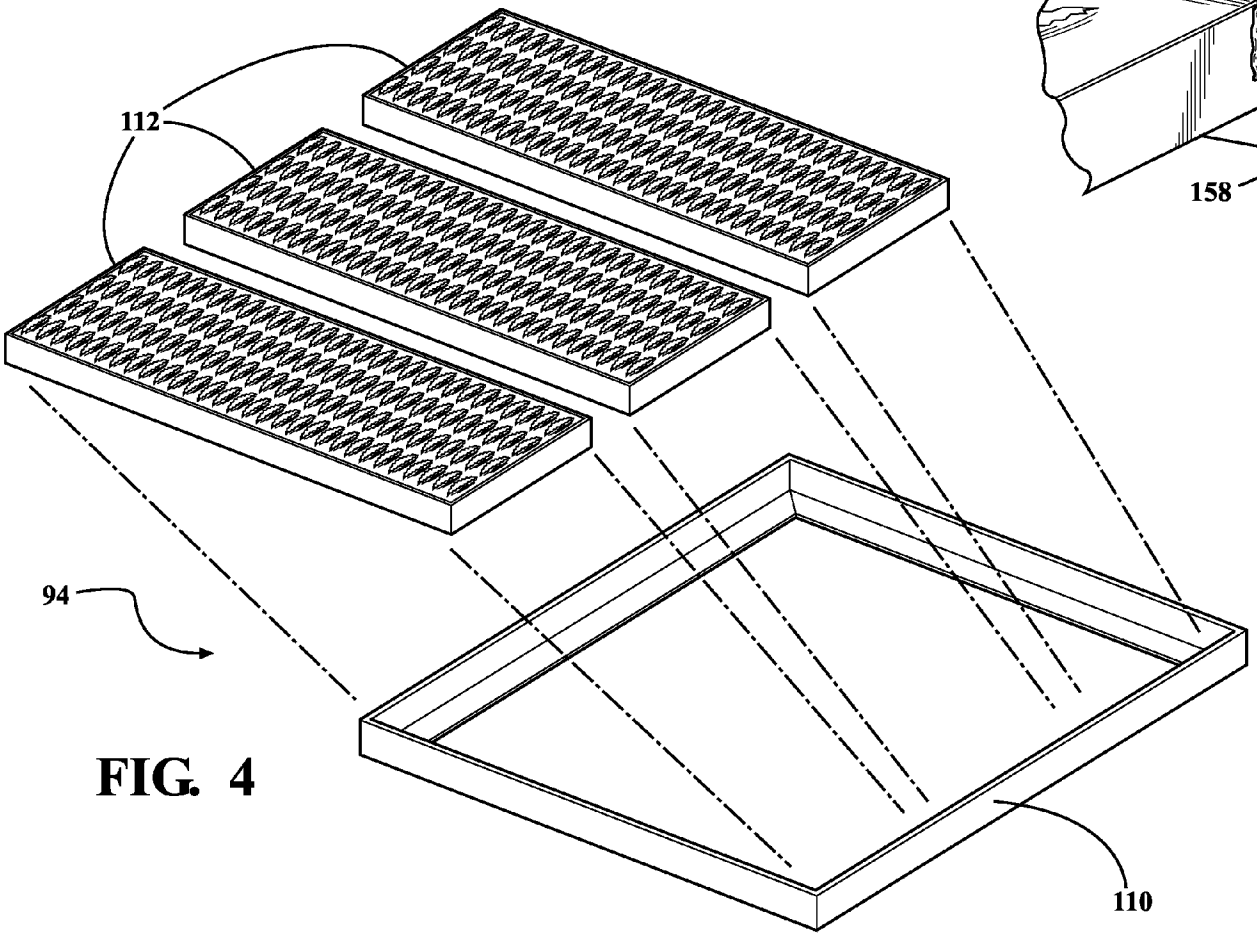
FIG. 4 is an exploded perspective view of one of the platform tread plates.
Figure 6:
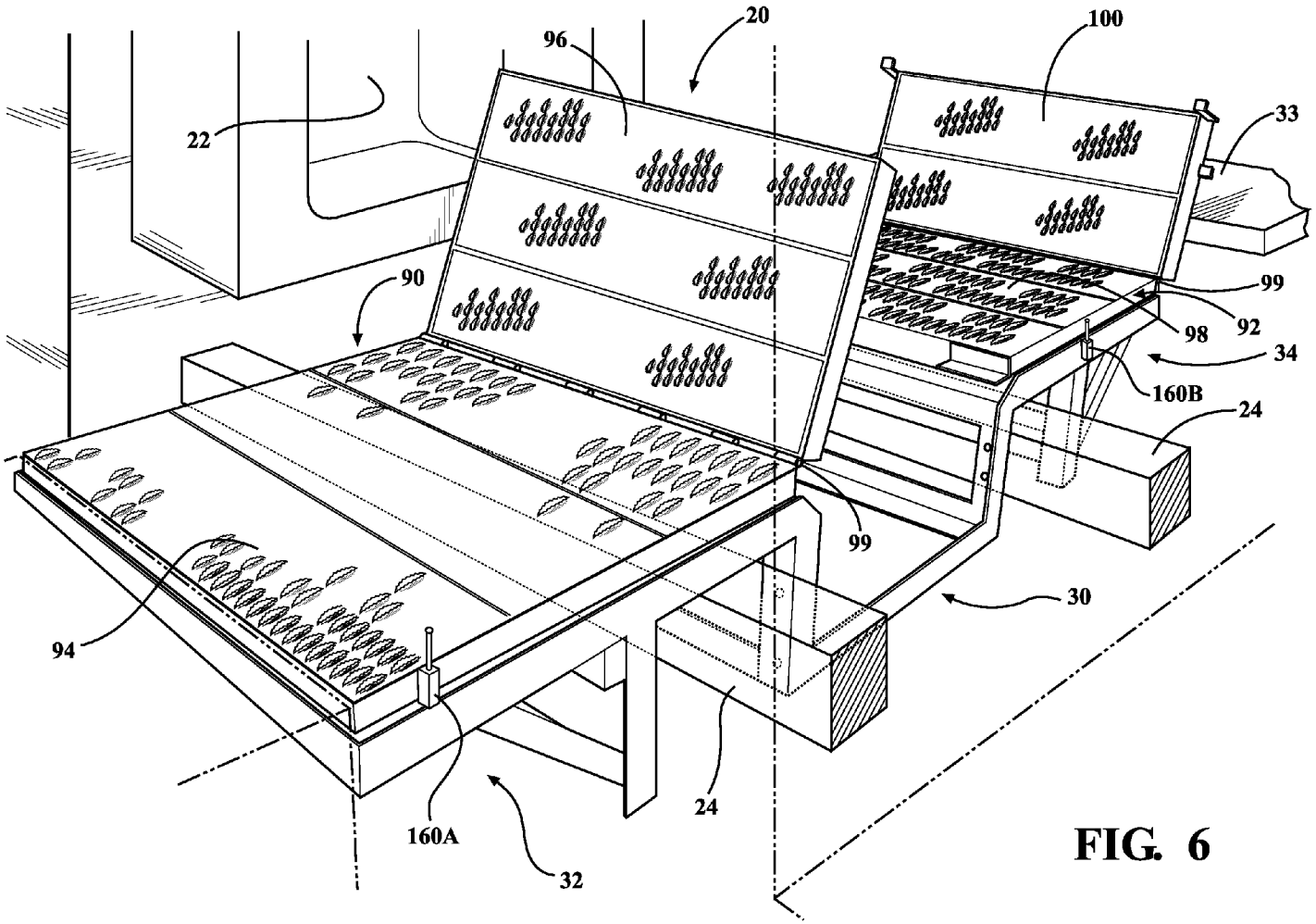
FIG. 6 is a perspective view showing the folding plates in a mid-position between retracted and extended positions.
Figure 7:
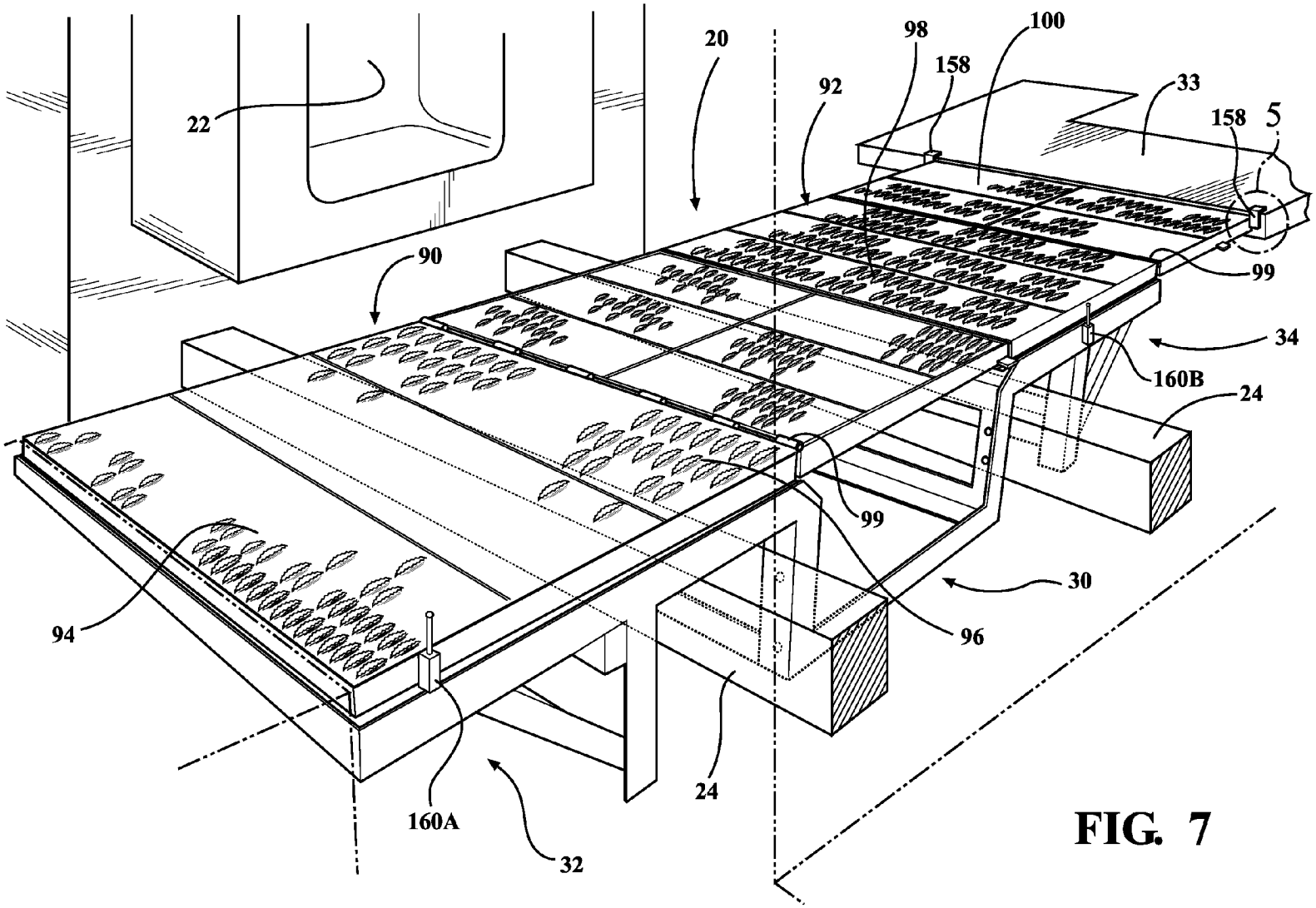
FIG. 7 is a perspective view of a platform with the plates in the extended position.

As shown in FIG. 2 and the following figures, and in detail in FIG. 4, the platform 20 includes a pair of plate assemblies including a first plate assembly 90 and a second plate assembly 92. The first plate assembly 90 is configured for mounting on the elevated first end portion 32 of the base 30. The second plate assembly 92 is configured for fixed mounting on the second end portion 34 of the base 30.

The first plate assembly 90 includes a first stationary plate 94 and a first movable plate 96. For example, the second plate assembly 92 also includes a first stationary plate 98 and a second movable plate 100. Both of the first and second plate assemblies 90 and 92 can be substantially identically constructed, but mounted in opposed orientations so that the second movable plates 96 and 100 move in the same direction about spaced parallel pivot axes between retracted and extended positions, as described hereafter.

The first stationary plate 94 as well as the first stationary plate 98 are each formed of a frame 110 constructed of end joined, such as welded, angle members. One or more individual tread plate assemblies 112 are mounted in and fixed, such as by welding, to each other and to the frame 110 of the stationary first and second plate assembly 90 or 92. The tread plates 112 may be formed of tread plate steel, which has undulating portions and weight reducing apertures. A solid plate, such as diamond step plate for example, may also be employed for the tread plates 112.

Each first and second plate assembly 90 and 92 is fixed, such as by welding, to the legs 50, 52, and 54 of each first and second portion ends 32 and 34 of the base 30.

Each second movable plate 96 and 100 is movably coupled to an underlying first stationary plate 94 and 98 respectively. Any suitable pivotal coupling may be employed, such as the living hinge 99 shown in FIG. 5. Each second movable plate 96 and 100 can be identically formed like the structure of the first stationary plates 94 and 98 and include an exterior frame, similar to frame 110 and a plurality of individual tread plates, similar to the tread plates 112.

As shown in FIG. 3, the hinge 130 on the first plate assembly 90 is disposed horizontally, vertically spaced above the upper cross member 72 of the base 30. The hinge 130 on the second plate assembly 92 is oriented closer to the end member 54 of the elevated second end portion 34, but parallel to the hinge 130 on the first plate assembly 90. This arrangement allows the second movable members 96 and 100 to pivot with respect to their first fixed stationary plates 94 and 98 in the same direction as shown in FIG. 4.

In the following description, the second movable plates 96 and 100 are described as being movable from a first retracted position shown in FIG. 3 wherein each second movable plate 96 and 100 is folded over and overlays the underlying respective first stationary plate 94 and 98. In this first retracted position, each second movable plate 96 and 100 is generally parallel to the underlying first stationary plate 94 and 98, respectively.

In the folded over, second retracted position of the second removable plates 96 and 100, a non-step surface of the respective second movable plates 96 and 100 is facing upward away from the platform 20. This non-step surface will be facing downward when the respective second movable plates 96 and 100 are in the extended position. Thus, the non-step surface of the second movable plates 96 and 100 is disposed to collect the metal flash, debris and fluid generated during the die-casting operation while protecting the opposed step surface of the second movable plates 96 and 100 as well as the step surface of the underlying first stationary plates 94 and 98 from debris and fluids.

Figure 8:
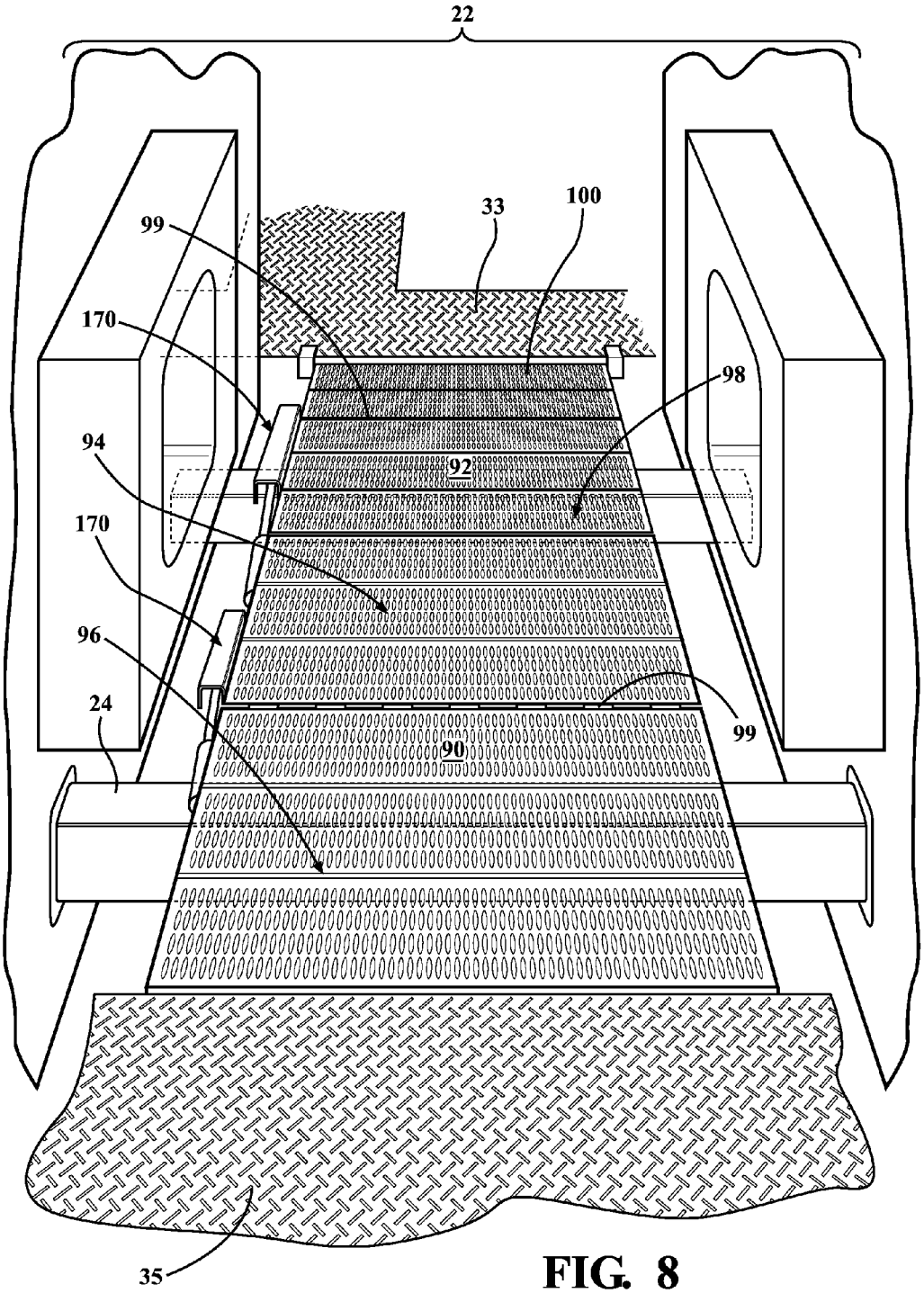
FIG. 8 is a perspective view showing the position of the ends of the platform with respect to an operator platforms of a die casting machine.

The second movable plates 96 and 100 are movable or articulable to a second extended position shown in FIG. 8 in which the second movable plates 96 and 100 and the first stationary plates 94 and 98 are generally in-line to form an extended elongated co-planar walking surface on the platform 20.

A support is provided for supporting the free end 150 of the second movable plate 96 and the free end 152 of the second movable plate 100 on adjacent structure when the second movable plates 96 and 100 are in a second fully extended position.

In one instance, the support is in the form of a ledge formed of one or more angle members 152 secured, such as by welding, to an end leg 155 of the first stationary plate 98. The angle members 152 include a co-planar lower leg 156 which receives the free end 150 of the first movable plate 96.

Figure 5:
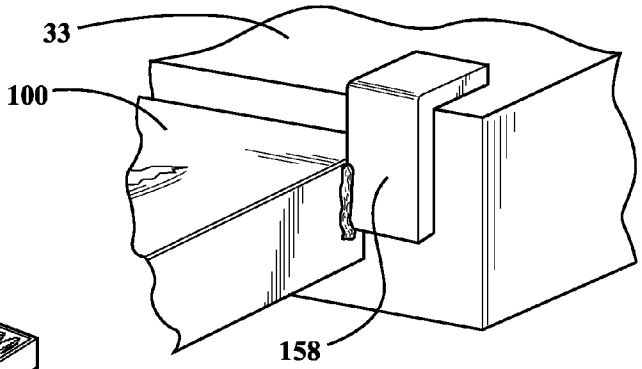
FIG. 5 is a partial perspective view of a support for one of the movable plates.

The support for the second movable plate 100 is provided by one or more angle brackets 158 which are fixed to one leg of the second movable plate 100, shown in FIGS. 2 and 5. The L-shaped angle brackets 158 are positioned to engage the operator's platform on the die-casting machine, as shown in FIG. 8, when second movable plate 100 is in the fully extended position.

Sensors 160A, 160B, 160C and 160D, seen in FIGS. 2, 9, 12, 13, and 14, such as limit switches, may be mounted at various locations on the base 30 or the first stationary plates 94 and 98 to detect the position of the second movable plates 96 and 100 in the retracted and the fully extended positions. Each sensor 160A and 160 B provides an output signal to the control system of the die casting machine 22 to indicate that the second movable plates 96 and 100 are in the fully retracted position before the die casting machine 22 can operate; as well as that the movable platen of the die casting machine 22 is in the retracted position before the second movable plates 96 and 100 can be moved to the fully extended position.

The sensors 160C and 160D are positioned on the opposite side of the base 30 of the platform 20 and are positioned to respectively detect the movable plates 96 and 100 in the fully extended position as shown in FIGS. 9, 12, 13, and 14. The output of the limit switches 160C and 160D are coupled to the machine control system to prevent operation of the machine and movement of the die platens when the platform 20 is in the fully extended position.

Although the second movable plates 96 and 100 may be manually extended and retracted, the platform 20 may include a powered actuator 170 for each second movable plate 96 and 100 to automatically move the second movable plates 96 and 100 between the first retracted position and the second extended position.

A separate actuator 170 is coupled to the first and second plate assemblies 90 and 92. Although a wide variety of drives may be employed, such as a pneumatic cylinder, etc., for example, the actuator 170 may include a linear actuator in the form of an electric motor powered ball screw 172 which has a first end affixed to the frame 110 via a pivotal clevis type connection shown in FIG. 10. The ball screw 172 has an extensible and retractable rod end 174 which is pivotally coupled to a linkage 176. The linkage 176 is in turn coupled to one of the second movable plates 96 or 100.

When actuated, the ball screw 172 cause extension of the rod 174 which unfolds the second movable plate 96 or 100 from the first retracted position in a 180° arc about the hinge 130 to the fully extended position. Activation of the ball screw 172 in an opposite direction causes the rod 174 to retract which pivots the second movable plate 96 or 100 back to the fully retracted position folded over and overlaying the respective first stationary plate 94 or 98.

Referring now to FIGS. 9-12, the ball screw 172 is coupled at one end to the first stationary plate 94 of each first and second plate assembly 90 and 92 via a pivotal connection. The pivotal connection includes a bar 180 fixed to one end of the housing ball screw 172 and extending therefrom along the longitudinal axis of the ball screw 172, for example. The opposite end of the bar 180 fits within a clevis 182 fixed by a block 184 to the first stationary plate 94. A pin 186 extends through apertures in the clevis leaves and the bar 180 to pivotally couple one end of the ball screw 172 to the first stationary plate 94.

As shown in detail in FIGS. 9-12, one end of the ball screw rod or shaft 174 is pivotally coupled to a linkage 176 formed of a first pair of parallel arranged links 192 and 194 which are fixedly interconnected by a strap or bracket 196 which is fixed to each link 192 and 194 by fasteners or welding, etc. Apertures 197 and 198 in one end of the links 192 and 194 receive a pivot pin 200 which fixedly extends from the movable first plate 196.

Figure 11:
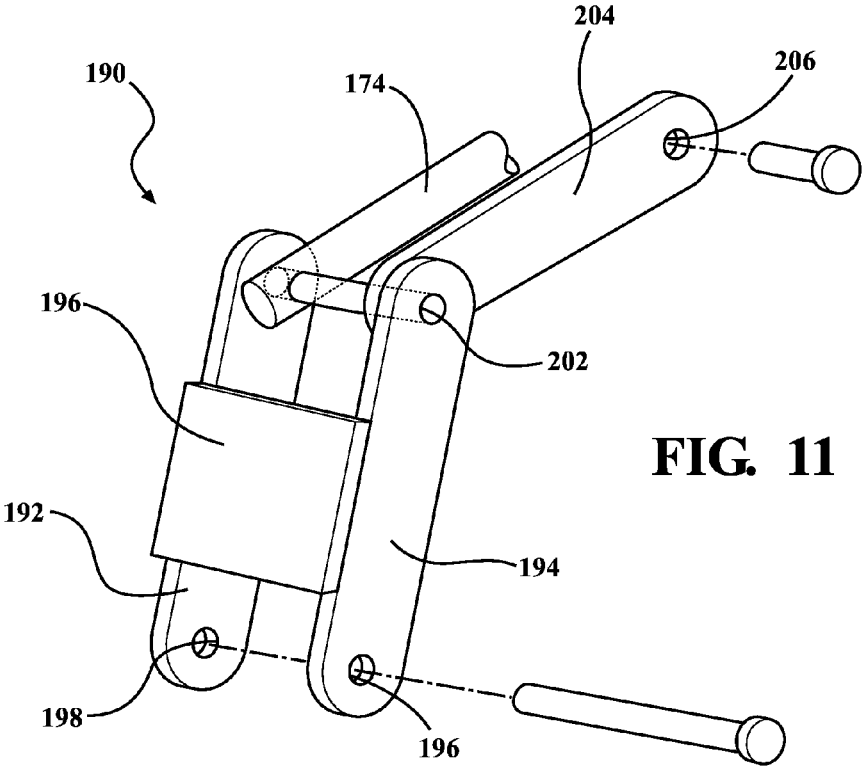
FIG. 11 is a perspective view of the linkage coupling the actuator to the pair of first and second plates.
Figure 13:
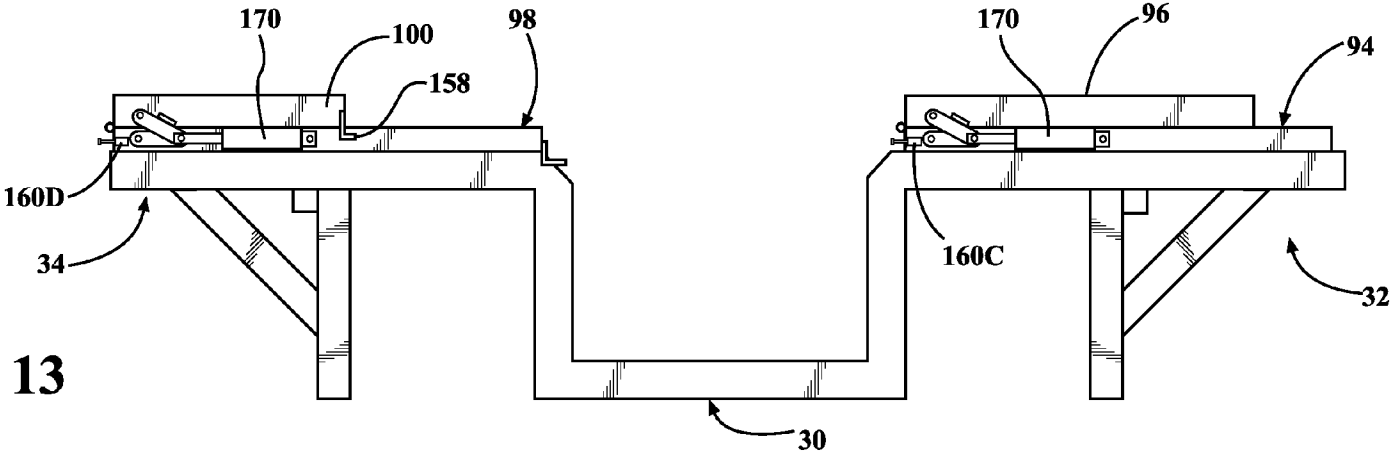
FIG. 13 is a side elevational view showing removal plates in the retracted position.
Figure 14:
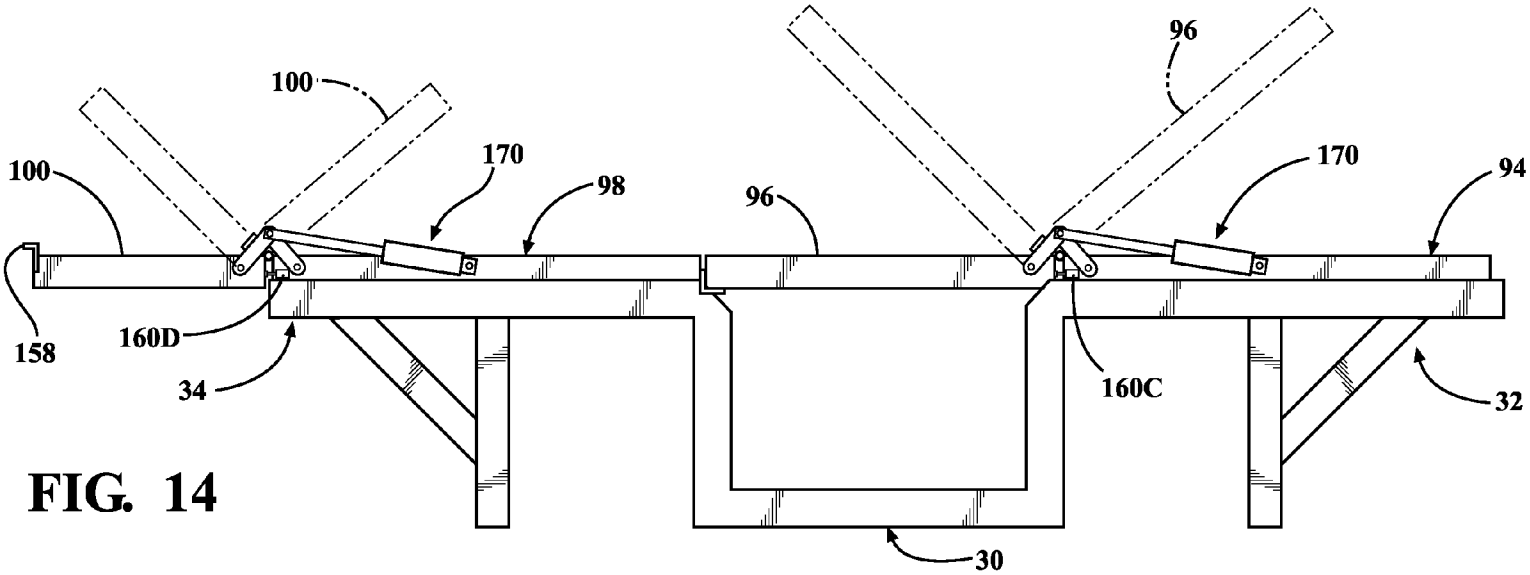
FIG. 14 is a side elevational view showing the movement of the movable plates from the retracted position shown in FIG. 13 to the fully extended position shown in FIGS. 2, 8 and 9.

The opposite ends of the links 192 and 194 also carry apertures, with only aperture 202 shown in FIG. 11. The apertures 202 form a pivot axis which includes one end of the ball screw rod 174 and one end of a third link 204. The opposite end of the third link 204 carries an aperture 206 which receives a bolt 208 to pivotally connect the third link 204 to the first stationary plate 94.

Figure 9:
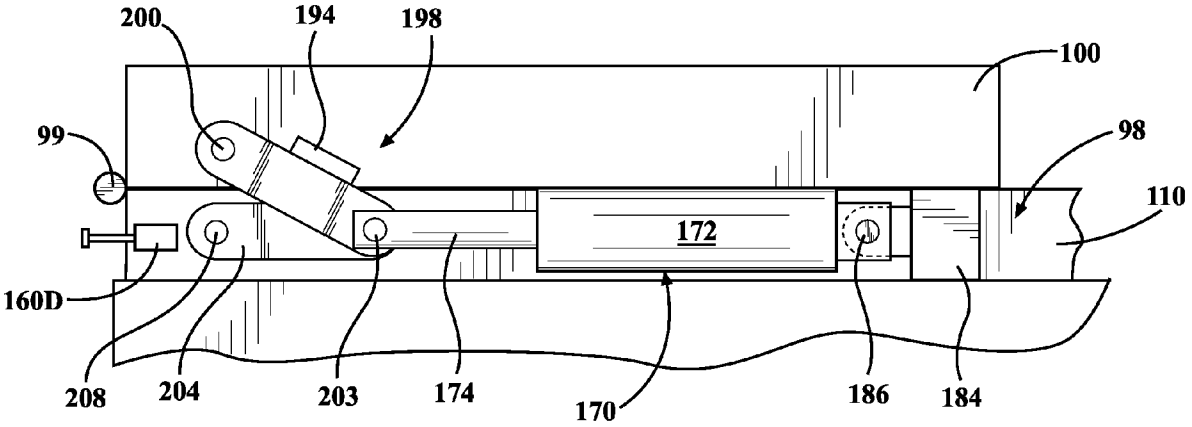
FIG. 9 is a side elevational view of one of the pairs of plates showing the power actuator in a retracted position.

When the ball screw 174 is retracted, as shown in FIG. 9, to define the retracted or folded over position of the second plate 96 relative to the first plate 94 of each first and second plate assemblies 90 and 92, the links 192, 194, 204 assume the positions shown in FIG. 9.

Figure 12:
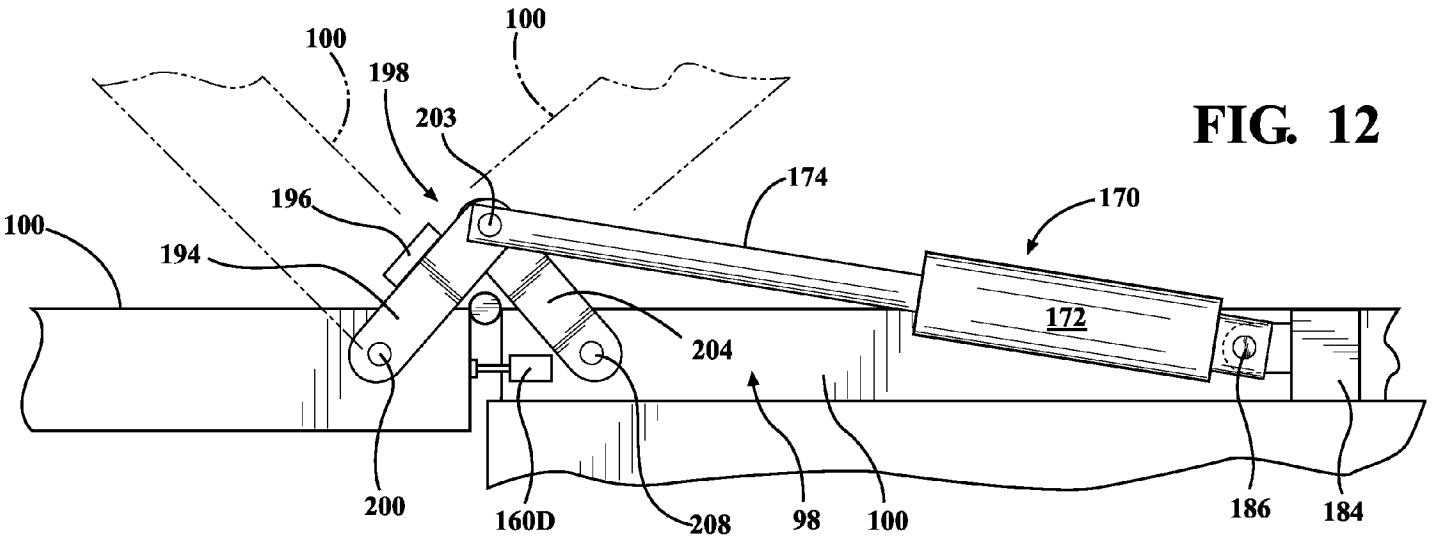
FIG. 12 is a partial, enlarged, side elevational view showing the position of the elements of the linkage when the first and second plates are in the extended position.
Figure 10:
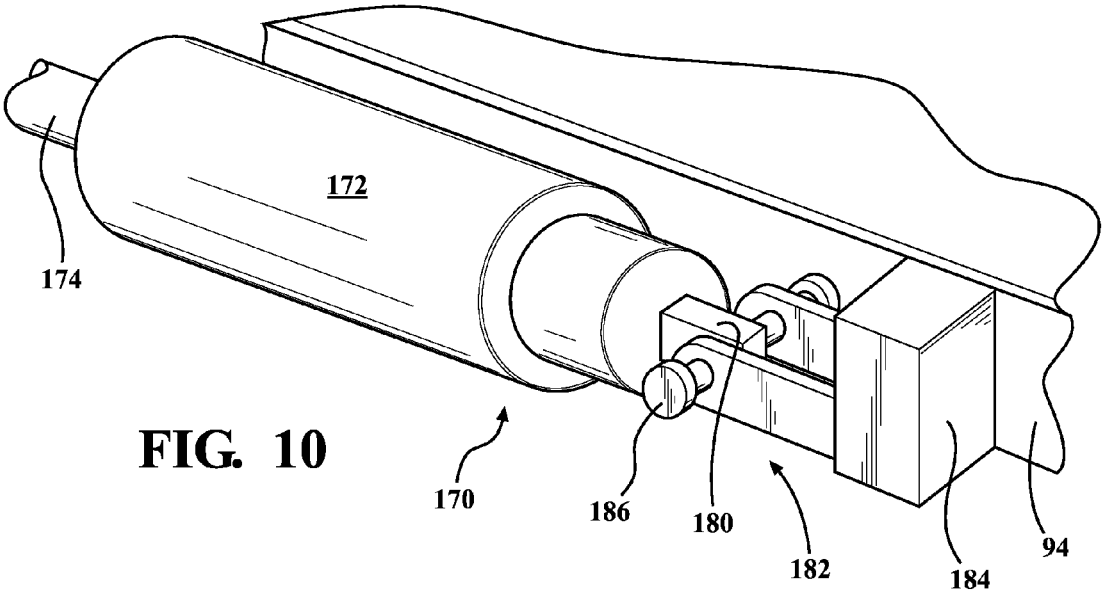
FIG. 10 is a partial perspective view showing a mounting of one end of the actuator to the one pair of first and second plates shown in FIG. 9.

When the ball screw 172 is activated to extend the second movable plate 96 relative to the first stationary plate 94, extension of the rod 174 relative to the ball screw 172 extends the link 204 causing the links 192, 194 and 204 to pivot about the respective pivot pins 200, 203 and 208 to expand the linkage 190 to the position shown in FIG. 12 which pivots the second movable plate 96 relative to the first stationary plate about the hinge 130 to the second extended position shown in FIG. 12.

Activation of the ball screw 172 in an opposite direction causes retraction of the rod 174 and a collapse of the linkage 190 back to the position shown in FIG. 9.

As described above, the base 30 can take different configurations. The base 30 may be formed of two separate non-connected bases, each carrying one of the first and second plate assemblies 90 and 92, respectively. The base 30, as described above and shown in FIGS. 1-8, may be a single elongated base carrying both of the first and second plate assemblies 90 and 92.

Figure 15:
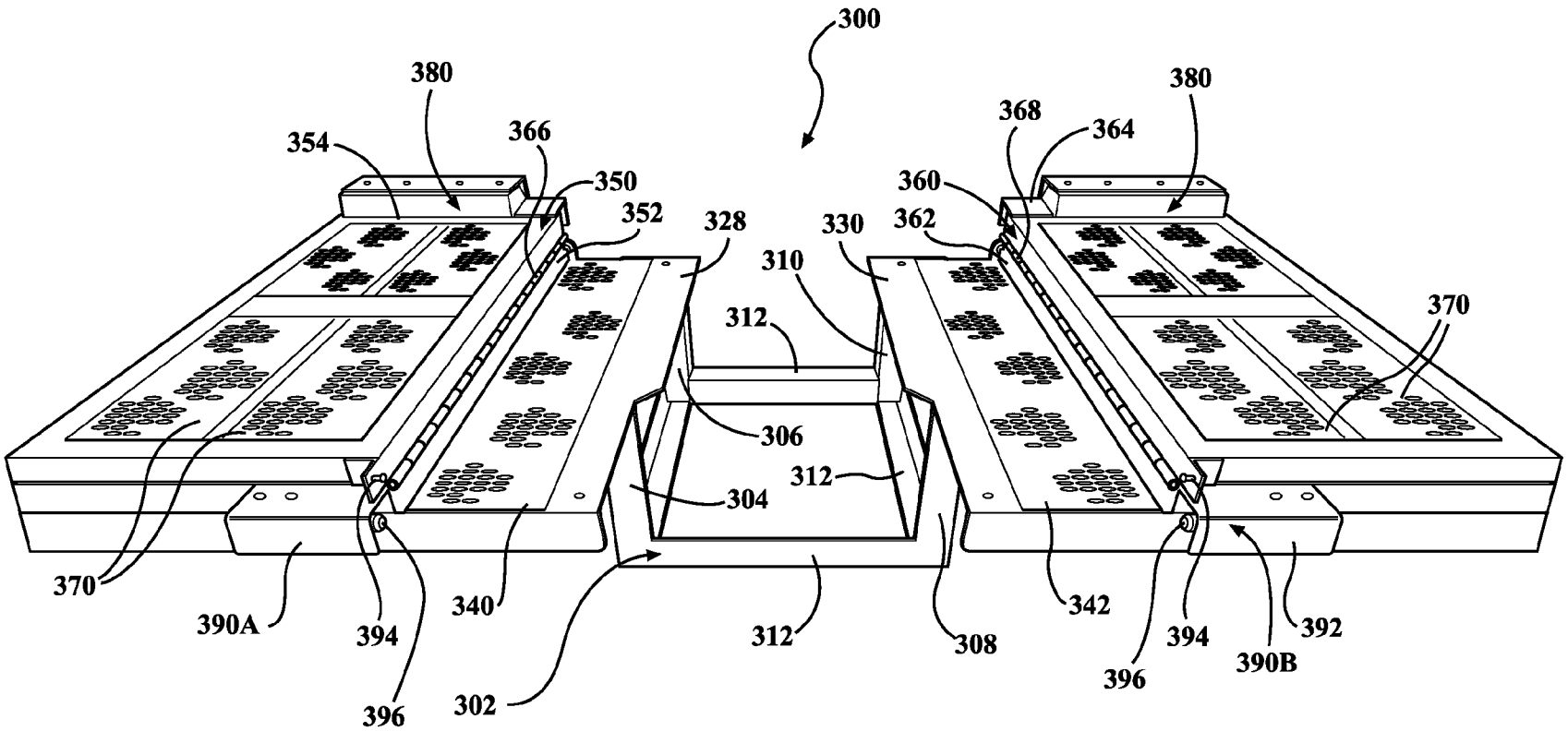
FIG. 15 is a perspective view of another aspect of a platform which can be employed in a die casting machine.
Figure 16:
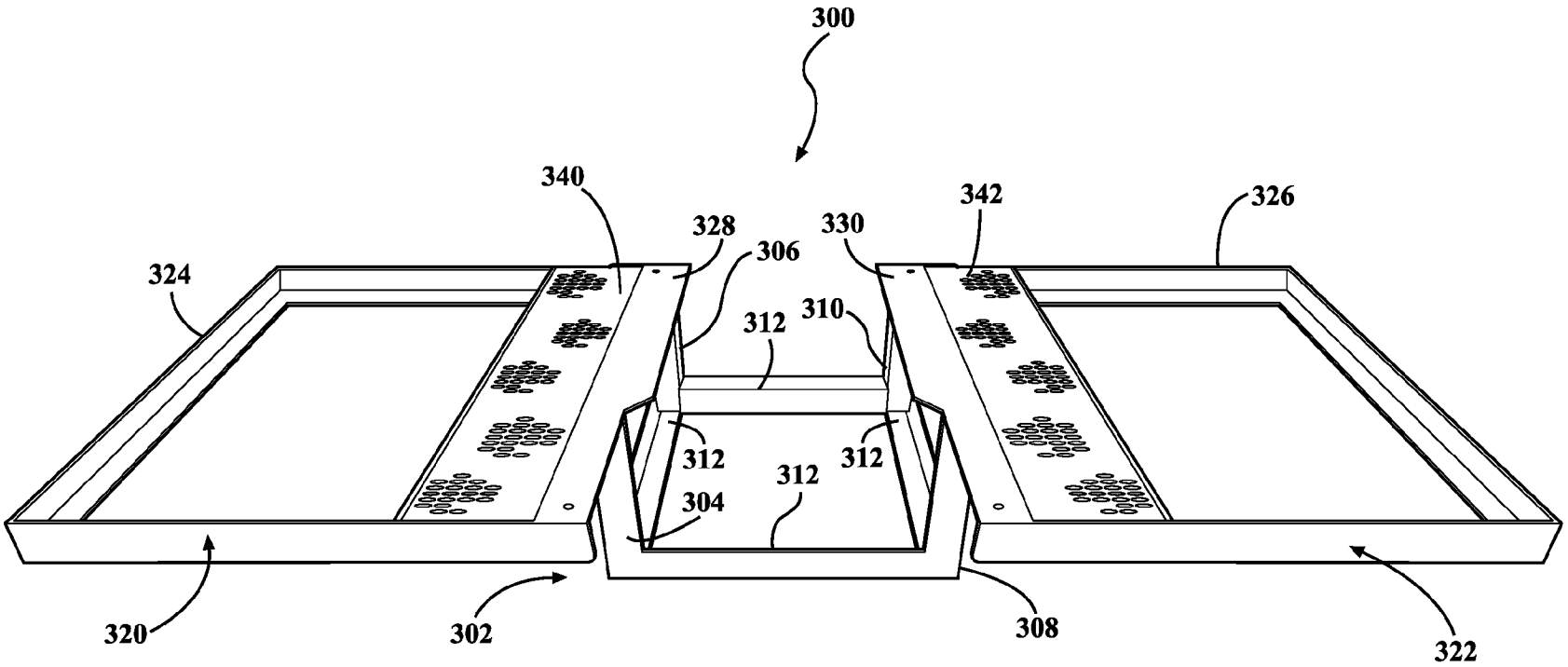
FIG. 16 is a partial perspective view of the base and lower portion of the platform shown in FIG. 15, with the pairs of stationary and movable plates removed.
Figure 17:
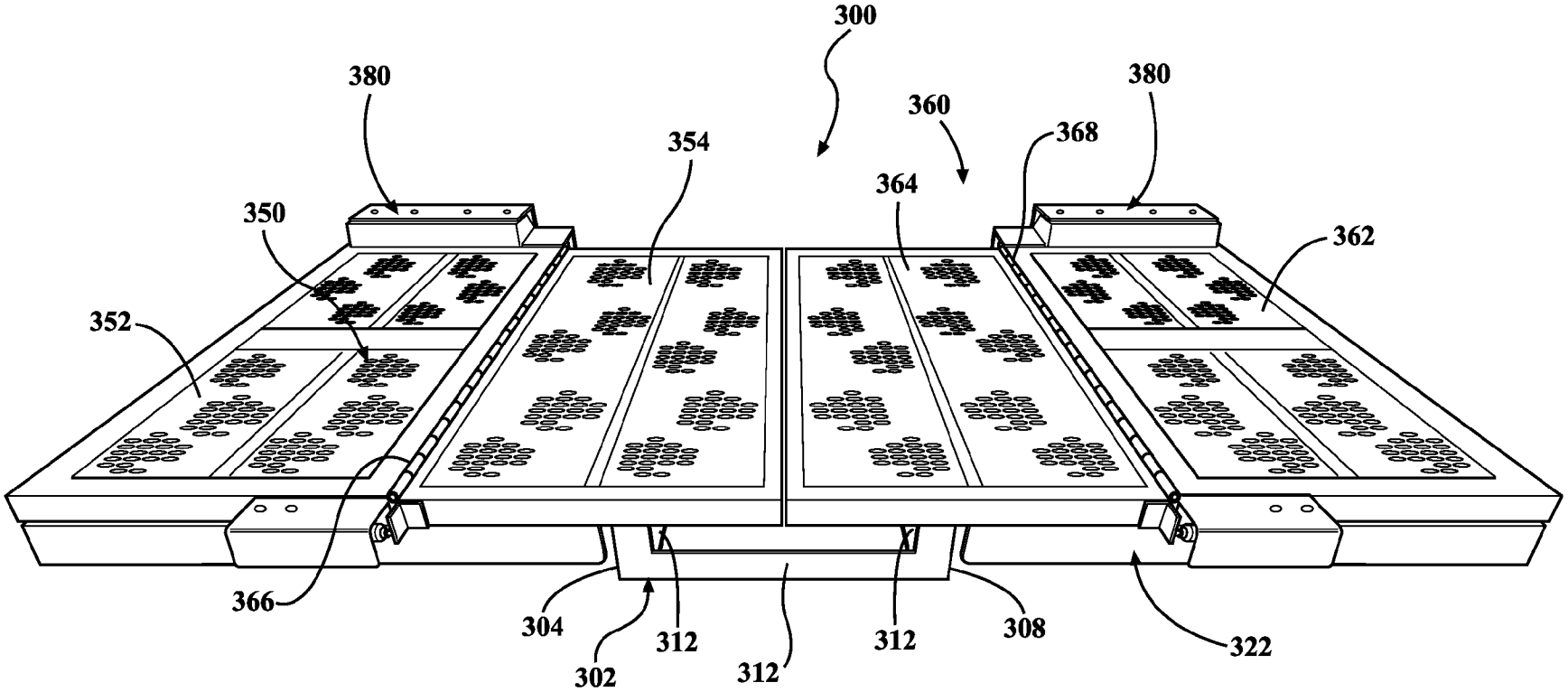
FIG. 17 is a perspective view of the platform shown in FIGS. 15 and 16, with the movable plates disposed in an extended position relative to the respective stationary plates.

Referring now to FIGS. 15, 16 and 17, there is depicted another aspect of a platform 300 for use in a die casting machine. The platform 300 is constructed and functions similarly to the platform 20; but has several structural differences.

The platform 300 includes a base 302 which can be formed of the steel members, such as angle irons. The base 302 includes a first pair of vertically extending, spaced legs 304 and 306 and a second pair of horizontally spaced, vertically extending, spaced legs 308 and 310. A plurality of lower interconnecting legs, all denoted by reference number 312, are fixedly interconnected between the lower ends of the legs 304, 306, 308, and 310.

First and second lower supports 320 and 322 extend horizontally in opposite directions laterally away from the base 302 from a fixed connection to the upper ends of the legs 304, 306, 308 and 310. The lower supports 320 and 322 are formed of a frame 324 and 326, which can be formed of welded angle irons. The frames 324 and 326 have a flat plate 328 and 330, respectively, fixed at one end and overlying and fixed to the upper ends of the legs 304 and 306, and 308 and 310, respectively.

Additional support legs or angled braces may be provided for each lower support 320 and 322, either as stand-alone supports coupled to the frames 324 and 326 of the lower supports 320 and 322 and/or fixed to one of the legs 304, 306, 308 and 310 of the base 302.

A tread plate or other platform surface, similar to the tread plates 112 shown in FIG. 4, is mounted at one end of the frames 324 and 326. The tread plates 340 and 342 are exposed and provide a walking or support surface for a worker when the pairs of movable and fixed plates, as described hereafter, are in a first retracted position as shown in FIG. 15.

As with the platform 20, the platform 300 includes a first pair of plates 350 formed of a first lower stationary plate 352 fixed to the lower support 320 and a movable upper plate 354; and a second pair of plates 360 including a first lower stationary plate 362 and a movable upper plate 364. The first and second stationary and movable plates 352, 354, 362 and 364 are formed substantially identical to the plates 92, 94, 96 and 98 described above for the platform 20 in that each plate 352, 354, 362 and 364 includes a peripheral frame with one or more sections of tread plate fixedly mounted therein.

The second movable plates 354 and 364 are respectively pivotally coupled via a hinge 366 and 368 to the underlying or lower disposed first stationary plates 352 and 362, respectively. The second movable plates 354 and 364 are pivotal from a first retracted position shown in FIG. 15 in which each movable plate 354 and 364 is folded over and overlays the respective first stationary plate 352 and 362; to a second extended position shown in FIG. 17 in which the second movable plates 354 and 364 overlay the tread plate surface 340 and 342 on the underlying lower supports 320 and 322, and a portion of the open center portion of the base 302 to form an elongated, continuous, co-linear platform with the adjacent stationary plates 352 and 362 as shown in FIG. 17.

The second movable plates 354 and 364, in this aspect of the platform 300, have one or more additional tread plate panels, with two tread plate panels 370 shown by example only in FIG. 15, mounted on a side of the frames supporting the tread plate sections which face upward when the second movable plates 354 and 364 are in the extended position shown in FIG. 17. The additional tread plate sections 370 are exposed and face upward when the second movable plates 354 and 364 are in the first retracted position shown in FIG. 15 thereby providing a rough, grippable walking surface, in conjunction with the tread plate surfaces 340 and 342 on the lower supports 320 and 322 for a worker to enter the die cast machine and use a portion of the platform 300 even though the second movable plates 354 and 364 have not been extended to the second fully extended position shown in FIG. 17.

An actuator 380, similar to the actuator 170 described above and shown in FIGS. 9-14 functions to bi-directionally pivot the second movable plates 354 and 364 back and forth between the first retracted position shown in FIG. 15, and the second extended position shown in FIG. 17.

Sensors 390A, 390B, 390C, and 390D, not shown in FIGS. 15-17, may be provided at various locations on the platform 300, in the same manner as the sensors 160A, 160B, 160C and 160D, to provide outputs indicating the position of each second movable plate 354 and 364.

In this aspect, the sensors 390A, 390B, 390C, and 390D, which can be in the form of plunger actuated limit or micro switches, are used in pairs to detect the retracted position of the second movable plates 354 and 364 and the extended position of the second movable plates 354 and 364. Each sensor 390A, 390B, 390C, and 390D is mounted in a cover plate 392 attached to the frame of one first stationary plate 352 or 354, on one side of the first stationary plates 352 and 354 as shown in FIG. 15. A bolt 394 or other protrusion is carried on one end of the frame of the second movable plates 354 and 364 and contacts the plunger 396 of the sensor 390 when the respective movable plate 354 or 364 is in the fully extended position. The sensor 390A or 390B provides an output signal to the machine control indicating that the second movable plates 354 and 364 are in the second fully extended position.

The second pair of sensors 390C and 390B are mounted on the opposite side of the platform 300 and are attached to the lower supports 320 or 322 or the first stationary plates 352 and 362 so as to be contacted by a flange or other projection on the respective second movable plates 354 and 364 when the second movable plates 354 and 364 reach the first fully retracted position shown in FIG. 15. The sensors 390C and 390D also provide output signals to the machine control to indicate that the second movable plates 354 and 364 are in the fully retracted position thereby enabling the die casting machine to cycle.

What is claimed is:

1. A platform for use in a machine having first and second members movable relative to each other, the platform comprising:

a base including a first end portion, a second end portion, and a recessed center portion, the recessed center portion located between the first end portion and the second end portion and defining an upward facing opening;

a stationary first plate positioned on the first end portion;

a movable second plate configured for rotational movement relative to the first plate between a retracted position and an extended position; and a sensor positioned on at least one of the base and the first plate, the sensor being configured to provide outputs indicative of a position of the second plate, the second plate being folded over the first plate in the retracted position such that the upward facing opening is not covered, and the second plate substantially covering the upward facing opening in the extended position such that a walkway over the upward facing opening is formed.

2. The platform of claim 1, wherein the second plate is pivotally coupled to the first plate.

3. The platform of claim 1, wherein, in the extended position, a portion of the second plate is supported on one of: a portion of the second end portion or a portion of the base portion.

4. The platform of claim 3, wherein, in the extended position, a portion of the second plate is supported by at least one angle member provided at the second end portion of the base.

5. The platform of claim 1, wherein the first end portion and the second end portion are substantially aligned and elevated relative to the recessed center portion.

6. The platform of claim 4, wherein the first end portion and the second end portion each include a plurality of frame members, the plurality of frame members of the first end portion configured to support the first plate.

7. The platform of claim 1, wherein the second plate is configured to be positioned end-to-end and substantially coplanar with the first plate when the second plate is in the extended position.

8. The platform of claim 1, further including an actuator coupled to the second plate for moving the second plate between the retracted position and the extended position.

9. The platform of claim 1, wherein the base is configured for mounting over tie rod covers of the die casting machine.

10. The platform of claim 1, wherein the first and second plates each include a tread plate surface, wherein the tread plate surfaces are exposed and face substantially upward when the second plate is in the extended position, and wherein the tread plate surfaces are not exposed and face each other when the second plate is in the retracted position.

11. The platform of claim 1, further including a stationary third plate positioned on the second end portion, and a movable fourth plate configured for rotational movement relative to the third between a retracted position and an extended position.

12. The platform of claim 11, wherein the fourth plate is configured to extend outward from the second end portion in a direction that is opposite the recessed center portion when in the extended position.

13. The platform of claim 12, wherein the first plate, the second plate, the third plate, and the fourth plate are substantially co-planar when the second plate and the fourth plate are in the extended position.

14. A platform for use in a die casting machine having first and second members movable relative to each other, the platform comprising:

a base including a raised first end portion, a raised second end portion, and a recessed center portion, the recessed center portion located between the first end portion and the second end portion and defining an upward facing opening, the base further configured to allow movement of the first and/or second members;

a stationary first plate positioned on the first end portion in a substantially horizontal position;

a movable second plate pivotally coupled to the first plate, the second plate pivotable relative to the first plate between a retracted position and an extended position, the second plate being folded over the first plate in the retracted position such that the upward facing opening is not covered, and the second plate extending from the first end portion to the second end portion in a substantially horizontal position in the extended position, the second plate being supported by at least one angle member provided at the second end portion of the base when in the extended position;

a stationary third plate positioned on the second end portion in a substantially horizontal position; and a movable fourth plate pivotally coupled to the third plate, the fourth plate pivotable relative to the third plate between a retracted position and an extended position, the fourth plate being folded over the third plate in the retracted position and the fourth plate being extended outward from the second end portion in a direction that is opposite the recessed center portion in the extended position.

15. The platform of claim 14, wherein the base is configured for mounting over tie rod covers of the die casting machine.

16. The platform of claim 14, wherein each of the first, second, third, and fourth plates include a tread plate surface that remains uncovered when the second and fourth plates are in their extended positions.

17. The platform of claim 16, wherein each of the second and fourth plates include a non-tread plate surface that covers the tread plate surfaces of the first and third plates when the second and fourth plates are in their retracted positions.

* * * * *